United States Patent [19]

Tentler et al.

[11] Patent Number: 4,462,163

[45] Date of Patent: Jul. 31, 1984

[54] BOW SIGHT

[75] Inventors: Lynn A. Tentler; Paul L. Peck, both of Fond du Lac, Wis.

[73] Assignee: Total Shooting Systems, Inc., North Fond du Lac, Wis.

[21] Appl. No.: 412,817

[22] Filed: Aug. 30, 1982

[51] Int. Cl.[3] ..... F41G 1/46

[52] U.S. Cl. ..... 33/265

[58] Field of Search ..... 33/265; 124/87

[56] References Cited

U.S. PATENT DOCUMENTS

| | | | |
|---|---|---|---|
| 3,365,800 | 1/1968 | Carella | 33/265 |
| 4,026,032 | 5/1977 | Smith | 33/265 |
| 4,166,324 | 9/1979 | Carollo et al. | 33/265 |
| 4,170,071 | 10/1979 | Mann et al. | 33/265 |
| 4,263,718 | 4/1981 | Smith | 33/265 |
| 4,309,827 | 1/1982 | Larson | 33/265 |

*Primary Examiner*—Richard R. Stearns

*Attorney, Agent, or Firm*—Bayard H. Michael

[57] ABSTRACT

The bow sight has three slots angled to the vertical. A sight pin is adjustably mounted in each slot by threaded means connected to a guide plate and extending through the slot to receive a lock nut. The threaded means can be a sight pin or a sleeve in which the sight pin is mounted. In the latter case a lock nut is also mounted on the sight pin to fix it against rotation. The guide plate bears on and is guided by an adjacent guide surface parallel to the slot.

7 Claims, 4 Drawing Figures

BOW SIGHT

BACKGROUND OF THE INVENTION

This invention relates to sighting devices used in archery. They are mounted on the bow to enable the archer to aim with greater accuracy. These devices are commonly called bow sights.

The better bow sights permit the sight to be adjusted for both range (distance) and windage. An example of such a bow sight may be seen in U.S. Pat. No. 4,026,032. That sight is generally acceptable although when multiple sighting pins are used it is not possible to get the pins very close together and the bearing surface between the sliding mechanism and the mounting plate is so small that it is easy to jam or cause jerky movement of the sight pin when making an adjustment.

SUMMARY OF THE INVENTION

The object of this invention is to provide a bow sight which can be adjusted easily and accurately. Another object is to provide a bow sight with multiple sighting pins which can be placed close together.

Another object of this invention is to reduce the cost of fabricating a bow sight by reducing the number of parts without sacrifice in quality or performance.

Two embodiments of the invention are shown. In both embodiments the sight or mounting plate is provided with parallel angled slots in which the sight pins are adjustably mounted. The slots are angled to permit slightly greater linear movement of the sight pin to effect a given vertical movement of the pin, thus increasing the accuracy of the range adjustment. In each embodiment there is a threaded member connected to a guide plate and extending through the slot to a lock nut on the opposite side of the mounting plate from the guide plate. The threaded member either threadably carries the sight pin or is the sight pin. The lock nut is tightened to clamp the mounting plate between the guide plate and the lock nut and thus hold the vertical (range) adjustment of the sight pin. The guide plate is guided by an adjacent parallel guide surface located some distance from the slot in which the sight pin moves. The plate is wide enough to guide the assembly smoothly without chatter or jamming.

In one embodiment the threaded member extending through the slot in the mounting plate is the sight pin itself and the lock nut runs down on the sight pin. In the other and preferred embodiment, the threaded member itself is a sleeve having an internal threaded bore receiving the sighting pin which has a threaded lock nut threadably mounted on the sight pin to run down against the other lock nut to fix the sight pin in an adjusted (windage) position. Thus, the lock nut on the sighting pin can be backed off to free the sight pin for windage adjustment without releasing the vertical (range) adjustment. Similarly, the vertical adjustment can be released for adjustment without affecting the windage adjustment.

DETAILED DESCRIPTION OF THE DRAWINGS

Figure 1:
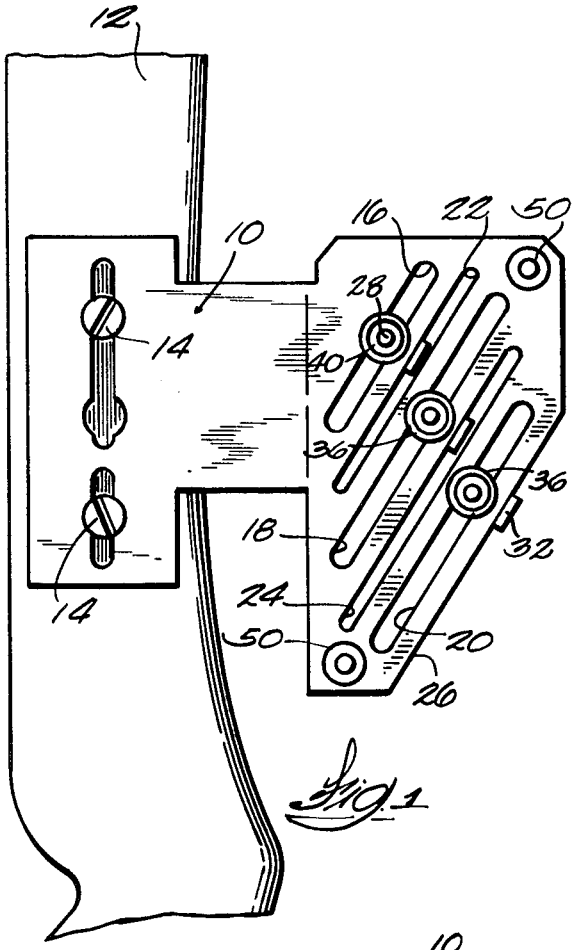
FIG. 1 is a side elevation of the bow sight mounted on the handle portion of a bow.

The bow sight has a plate 10 retained on the handle 12 of the bow by two screws 14 which extend through the slot in the mounting plate and fix the plate on the bow handle. In FIG. 1 the right hand portion of the plate 10 is provided with three parallel angled slots 16, 18, 20. There are narrower slots 22, 24 parallel to slots 16, 18 while the edge 26 of the plate is cut off parallel to slot 20. This arrangement provides a guide surface for each sighting pin which will be explained more fully hereinafter.

Figure 3:
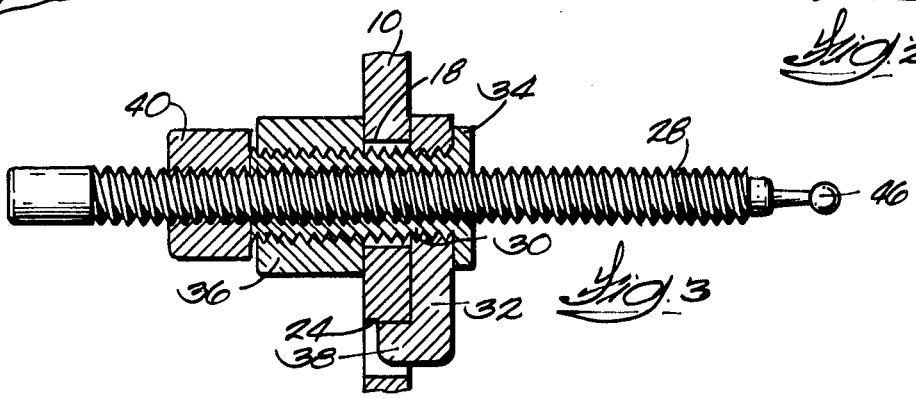
FIG. 3 is a detailed section through one of the sight pins and mount taken on line 3—3 in FIG. 2.

A sight pin 28 is mounted in each of the wider slots 16, 18, 20 and it will be understood that more sight pins could be used if desired. As shown in FIG. 3, pin 28 is threadably mounted in sleeve 30 which in turn is threadably mounted in guide plate 32 with head 34 of the sleeve 30 bearing against the guide plate. Sleeve 30 does not threadably engage plate 10 but extends freely through slot 18 to project in the other side of the plate. Knurled nut 36 is threadably mounted on the rearward projection of the sleeve to clamp or engage the plate 10 between the guide plate and the nut and fix the sight pin vertical location. The guide plate extends laterally from the slot 18 and has a finger 38 extending into and engaging the edge of slot 24 to guide the movement of the plate as it slides along slot 18. Since the guide plate has substantial width the movement is smooth and chatter free.

Figure 2:
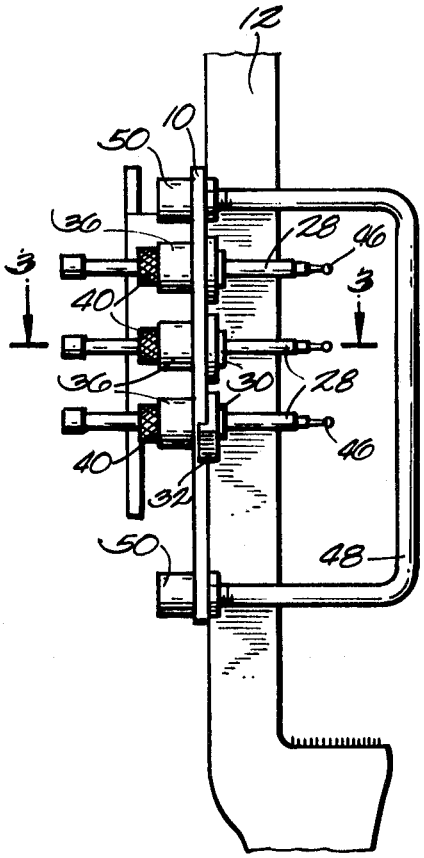
FIG. 2 is a rear elevation (or an elevation from the right side of FIG. 1) showing the sight as it would appear to the archer.

Knurled lock nut 40 is mounted on the rear or left end of the sight pin. When this is tightened against sleeve 30 the sight pin is locked against rotation. When the lock nut 40 is backed off the sight pin can be rotated to move left or right in FIG. 2 or 3 to adjust for windage. If the windage adjustment is satisfactory but the range (distance) adjustment is to be changed, the large nut 36 can be backed off a touch (not enough to engage nut 40) to permit the vertical adjustment to be made and the nut retightened without changing the setting of nut 40. In other words, nut 36 can be loosened, the sight pin moved and nut 36 tightened again and during that adjustment the nut 40 will remain tight against sleeve 30 and the windage adjustment will remain fixed. When adjusting for windage alone, the lock nut 40 is loosened while the sight pin is held or restrained against rotation in the sleeve 30 since the pin tends to follow along with the nut 40. Then the knurled end of the pin is turned to adjust for windage. Then the nut 40 is tightened to lock the pin.

With the slots 16, 18, 20 angled at about 30° to the vertical, it takes slightly more linear movement to move the sight pin a given distance vertically. This makes it easier to make small adjustments. In other words, the actual vertical adjustment made is smaller than the angled distance the pin is moved. This is an advantage. Providing multiple slots permits the pins to be mounted as close together (as vertically perceived by the archer) as desired. The prior art using a single slot necessarily spaced the pins further apart to allow for the mounting mechanism.

Figure 4:
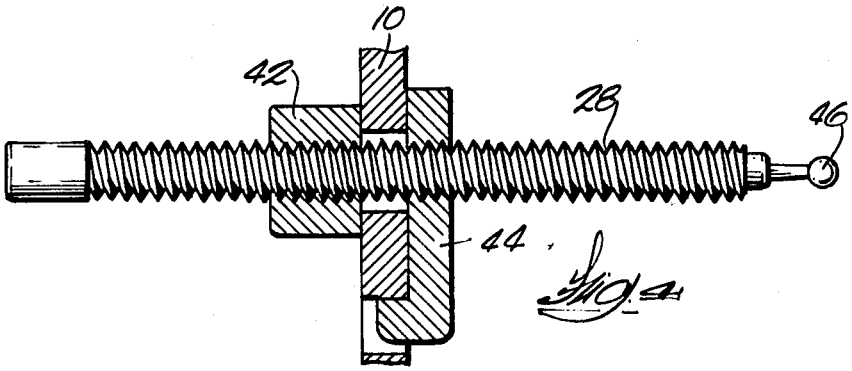
FIG. 4 is a modified simpler construction.

The modification shown in FIG. 4 is simpler and is also less desirable in that it has but a single lock nut 42 threaded on sight pin 28 and bearing against the sight plate 10. The sight pin is directly threaded into the guide plate 44. Thus, with this arrangement when either the range or windage is to be adjusted lock nut 42 is loosened and the entire arrangement is now free to move in any direction. That is, the sight pin can be rotated (windage) and the mount can be moved along the slot (range). While the user develops some dexterity doing this, this arrangement is not as desirable as the first embodiment.

It will be noted that in the two embodiments there is a threaded member engaged with or connected to the guide plate and extending through the slot in the sight plate to receive a lock nut which can be tightened to lock the sight in place. In the FIG. 3 embodiment the threaded member is the sleeve 30 which receives the lock nut 36 while in the FIG. 4 embodiment the threaded member is the sight pin which has the lock nut 42 threadably mounted on it.

The sight pin has a machined ball like end 46 to which luminous paint is preferrably applied to help aiming in poor light conditions. The pins are protected by the guard 48 having its threaded ends projecting through holes in the plate and secured by knurled nuts 50.

It will be noted that the guide slots adjacent the mounting slots function not only to assure smooth movement of the sight pin during adjustment but also serves to remove material from the mounting plate and thus reduce weight. Similarly, cutting off the corner to provide the guide surface 26 reduces weight. Those familiar with bows will appreciate that weight reduction is an important factor in the performance of the bow and in the use of the bow.

We claim:

1. A bow sight comprising, a mounting plate adapted to be fixed on a bow so the plane of the plate is vertical when the bow is used in its usual vertical position, said mounting plate having a slot therein, one end of said slot being substantially above the other end of the slot, a guide surface parallel to the slot, a guide plate having a portion engaging said guide surface, means connected to the guide plate and extending from the guide plate through said slot to project on the other side of the mounting plate, said means including a sight pin, a lock nut mounted on said means to fix the vertical position of the sight pin in said slot.

2. A bow sight according to claim 1 in which said means comprises a sleeve having a threaded bore in which said sight pin is mounted, and a second lock nut threadably mounted on the sight pin to jam against the sleeve to fix the lateral position of the sight pin.

3. A bow sight according to claim 1 in which said means is said sight pin.

4. A bow sight according to claim 1 in which there are a plurality of slots in the sight plate, all of said slots being angled relative to vertical and being spaced so that a sight pin mounted in a given slot does not interfere with the sight pin in an adjacent slot.

5. A bow sight comprising, a mounting plate adapted to be fixed on a bow so the plane of the plate is vertical when the bow is used in its usual vertical position, said mounting plate having a plurality of parallel slots therein angled more than 20° relative to the axis of the bow when the mounting plate is fixed to the bow, a sight pin mounted in each slot by mounting means permitting adjustment of the pin along the length of the slot and transversely of the plate, said slots being spaced far enough to accommodate said mounting means without interference with or from adjacent mounting means, the angular relationship of said slots to the axis of the bow resulting in and requiring more linear movement of a sight pin in a slot than the desired vertical adjustment of the sight pin.

6. A bow sight comprising, a mounting plate having a slot therein and a guide surface parallel to the slot, a support including a portion engaging and guided by said guide surface, a sight pin threaded into the support so the sight is on the same side of the mounting plate as the support, a lock nut threaded onto the sight pin on the other side of the mounting plate so the lock nut will fix the support and the pin against movement when the nut is tightened.

7. A bow sight comprising, a mounting plate having a slot therein and a guide surface parallel to the slot, support means including a portion engaging and guided by said guide surface, a sight pin threaded into the support means so the sight is on the same side of the mounting plate as the support means, a lock nut threaded onto the sight pin on the other side of the mounting plate so the lock nut will fix the support means and the pin against movement when the nut is tightened, and separate threaded means for clamping the support means to the mounting plate independently of said lock nut whereby said lock nut can be backed off to adjust the sight pin without the support means moving relative to the mounting plate.

* * * * *